US005641234A

United States Patent [19]

Blumberg

[11] Patent Number: 5,641,234

[45] Date of Patent: Jun. 24, 1997

[54] FILE FASTENER

[75] Inventor: Murray Basil Blumberg, Sandton, South Africa

[73] Assignee: Press Engineering (Proprietary) Limited, South Africa

[21] Appl. No.: 324,098

[22] Filed: Oct. 14, 1994

[30] Foreign Application Priority Data

Oct. 18, 1993 [ZA] South Africa ..... 93/7707

[51] Int. Cl.[6] ..... B42F 13/00

[52] U.S. Cl. ..... 402/8; 402/14; 402/75; 402/80 R

[58] Field of Search ..... 402/7, 8, 14, 13, 402/19, 80 R, 70, 75, 73; 29/412, 417

[56] References Cited

U.S. PATENT DOCUMENTS

| | | | |
|---|---|---|---|
| 428,575 | 8/1890 | Dimatteo | 29/412 X |
| 1,465,783 | 8/1923 | Polzer | 24/703.5 X |
| 3,741,385 | 6/1973 | Corey | 402/18 X |
| 3,867,743 | 2/1975 | Corey | 402/14 |
| 4,950,097 | 8/1990 | Blumberg | 402/8 |
| 4,993,861 | 2/1991 | Blumberg et al. | 402/8 |
| 5,059,051 | 10/1991 | Corey | 402/80 R X |

*Primary Examiner*—Frances Han
*Attorney, Agent, or Firm*—Wood, Herron & Evans, LLP

[57] ABSTRACT

A file fastener, which is of a flat metal strip having top and bottom surfaces with narrow side surfaces therebetween, includes an elongate body portion. A prong extends from each end of the body portion, with at least the side surfaces of the prongs having a protective coating. The invention extends to a string of file fasteners, each file fastener being of a flat metal strip and having an elongate body portion. A prong extends from each end of the body portion, with the file fasteners being connected via frangible bridges. The invention also extends to a method of manufacturing file fasteners.

9 Claims, 2 Drawing Sheets

FILE FASTENER

FIELD OF INVENTION

This invention relates to a file fastener, more particularly to file fasteners that are of a metal. Further, the invention relates to a method of manufacturing the file fasteners and to an intermediate article which is supplied in the process of manufacturing the file fasteners.

SUMMARY OF INVENTION

According to a first aspect of the invention, there is provided a file fastener, which is of a flat metal strip having top and bottom surfaces with narrow side surfaces therebetween, which includes an elongate body portion; and a prong extending from each end of the body portion, with at least the side surfaces of the prongs having a protective coating.

The top and bottom surfaces of the prongs may have the protective coating and the body portion may also have the protective coating.

Those skilled in the art will further appreciate that the prongs may be coated with any suitable material, which may be a paint, an epoxy material or the like.

Each prong may be narrower than the body portion to define a pair of shoulders at each end of the body portion. The shoulders may be substantially square.

According to a second aspect of the invention, there is provided a string of file fasteners, each file fastener being of a flat metal strip and having an elongate body portion with a prong extending from each end of the body portion, with the file fasteners being connected via frangible bridges.

The fasteners may be arranged in a side-by-side manner. A ribbon may be arranged along at least one side of the string, each file fastener being attached to the, or each, ribbon by means of a frangible bridge at the tip of one, or both, prongs.

The string may have two ribbons, one on one side and the other on the other side of the file fasteners, each file fastener being attached to both ribbons by frangible bridges at the tips of the prongs.

The ribbons of the string may have apertures whereby the ribbons and elements attached thereto may be displaced when the prongs are coated. It will be appreciated still further that, once the prongs have been coated, the elements are parted from the ribbons, leaving only a very small area at the tip of each prong, which is not coated.

Instead, the file fasteners may be arranged in a side-by-side manner with the body portions of adjacent file fasteners connected by a frangible bridge. With this embodiment, the problems associated with having the small area at the tip of each prong uncoated are avoided.

According to a third aspect of the invention, there is provided a method of manufacturing a file fastener, which is of a flat strip having top and bottom surfaces with narrow side surfaces therebetween and having an elongate body portion with a prong extending from each end of the body portion, the method including the steps of:

forming the body portion and the prongs; and applying a protective coating to at least the side surfaces of the prongs.

The method may include also applying a protective coating to the top and bottom surfaces of the prongs. The protective coating may be applied to the body portion.

The file fastener may be parted from a sheet of the metal. The body portion and the prongs may be parted in a single operation. Instead, the body portion and the prongs may be parted in at least two separate operations.

The fasteners may be parted from the sheet of metal so that the body portions of the fasteners are adjacent one another to provide a string of file fasteners, the file fasteners being connected via frangible bridges.

The fasteners may be parted so that each fastener is attached, at an end of at least one prong, to a ribbon via a frangible bridge. The fasteners may be parted so that each fastener is attached, at the ends of both prongs, to a ribbon via a frangible bridge. Alternatively, the fasteners may be parted so that the body portion of each fastener is connected to the body portion of an adjacent fastener by a frangible bridge.

The method may include coating the prongs of the fasteners of the string with the protective coating. The body portions of the fasteners of the string may also be coated with the protective coating.

The coating may be applied in any suitable manner, such as by spraying, by means of rollers or in any other appropriate manner.

The method may include the steps of parting the prongs from the sheet of metal, coating at least the side surfaces of the prongs and then parting the body portions from the sheet of material. It will be understood that, in this case, the frangible bridges will not be formed at any stage.

By means of the invention, because edges of the prongs are coated, the prongs are less likely to corrode and also any burrs will be covered thereby minimising the possibility of injury to a person using the file fastener. Further, as only the prongs are coated, less coating material is utilised than would be the case if the body portions were also coated. Still further, by utilising the file fastener elements in string form, simpler and cheaper coating techniques and equipment may be utilised. In addition, if the intermediate string is manufactured, it is possible to increase the speed at which the elements are manufactured.

The invention is now described, by way of example, with reference to the accompanying drawings.

DETAILED DESCRIPTION OF THE DRAWINGS

Figure 1:
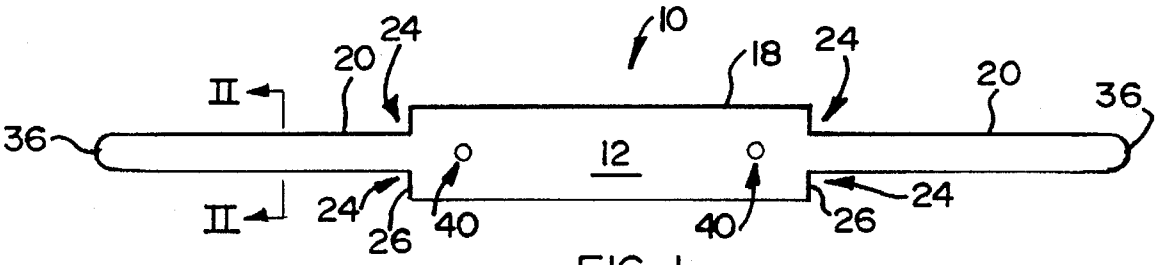
FIG. 1 shows a file fastener in accordance with a first aspect of the invention.
Figure 2:
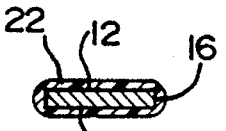
FIG. 2 shows a cross-sectioned view of the file fastener taken through II—II in FIG. 1.

In the drawings, reference numeral 10 generally indicates a file fastener in accordance with a first aspect of the invention.

Each file fastener 10 is of a flat metal strip. Each file fastener 10 has a top surface 12 and a bottom surface 14 with narrow side surfaces 16 therebetween.

The file fastener 10 includes an elongate body portion 18 and a prong 20 extending from each end of the body portion 18.

The side surfaces 16 and the top and bottom surfaces 12, 14 of the prongs 20 have a protective coating 22.

Each prong 20 is narrower than the body portion 18 to define a pair of shoulders 24 at each end 26 of the body portion 18. The shoulders 24 are substantially square.

Figure 3:
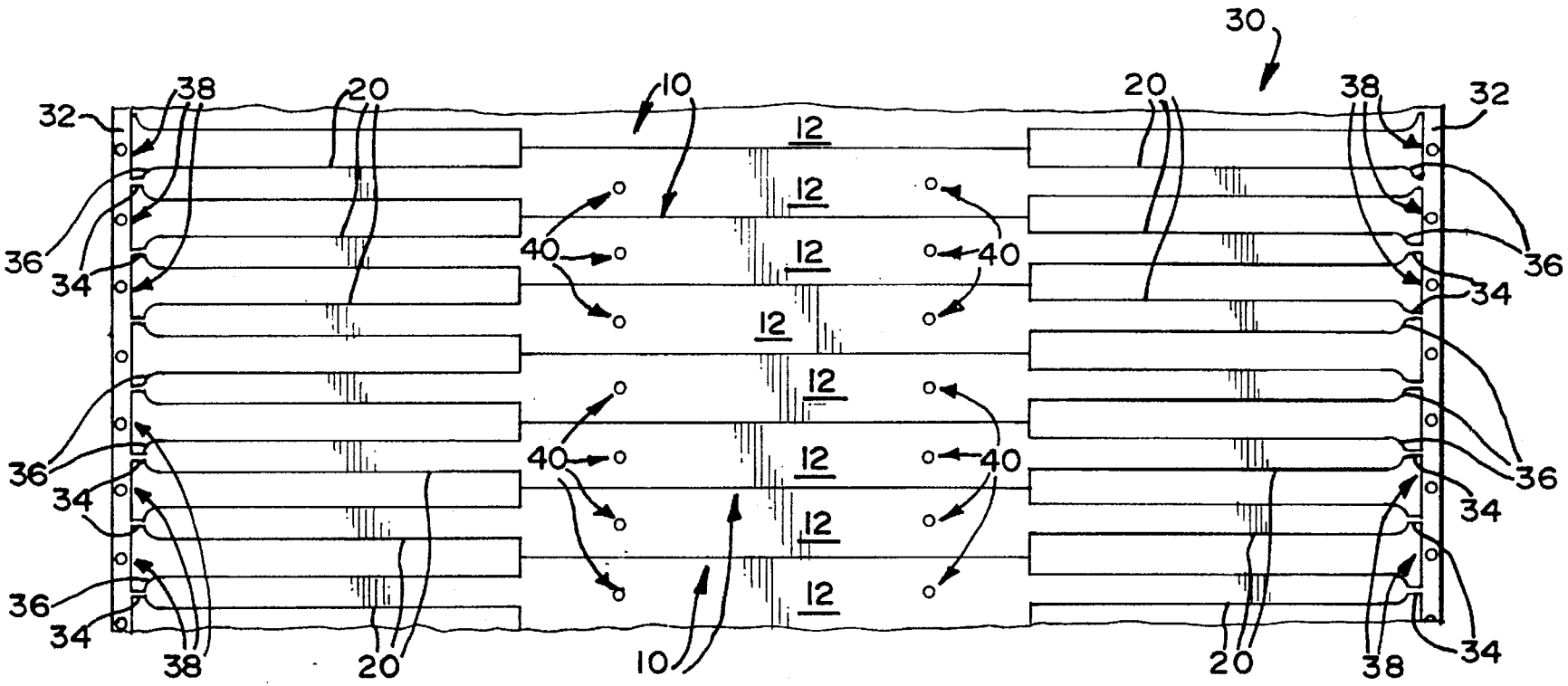
FIG. 3 shows a string of file fasteners in accordance with a first embodiment of a second aspect of the invention.

In FIG. 3, reference numeral 30 generally indicates a string of the file fasteners 10 in accordance with a first embodiment of a second aspect of the invention.

In the string 30, the fasteners 10 are arranged in a side-by-side manner. A ribbon 32 is arranged on both sides of the file fasteners 10, each file fastener 10 being attached to both ribbons 32 by frangible bridges 34 at tips 36 of the prongs 20.

The ribbons 32 have apertures 38 by means of which the string 30 can be moved through a coating apparatus (not shown). The ribbons 32 and the fasteners 10 are formed by a punching operation, using suitable dies. The fasteners 10 may be formed one at a time in one operation or they may be formed in a plurality of punching operations, again one fastener 10 being formed at a time with each operating stroke, or a plurality of fasteners 10 being formed at a time with each operating stroke, with each of the fasteners 10 being formed with one stroke or with the fasteners 10 being formed by a number of operations. It will be appreciated that material between adjacent prongs 20 must be removed and adjacent body portions 18 separated as well as the apertures 38 and apertures 40 in the body portions 18 being formed.

Thus, the material between the prongs 20 may be removed, a parting cut between adjacent body portions 18 made, and the apertures 38 and 40 formed in one stroke. Instead, the material between the prongs 20 may be removed in one stroke, the parting line made between the body portions 18 in another stroke at a different position and the apertures 38 and 40 formed in a further punching operation at a still further position.

It will further be appreciated from what has been said in the introductory part of the specification, that the prongs 20 are coated with a paint or epoxy composition and after being coated, the fasteners 10 are separated from the ribbons 32. It will be appreciated further that the body portions 18 are not coated although they may be. Thus, top and bottom surfaces 12, 14 of the prongs 20 and the side surfaces 16 are coated.

The only parts of the prongs 20 that are not coated once the fasteners 10 have been separated from the ribbons 32 are small areas at the tips 36 of the prongs 20 where the bridges 34 were. The prongs 20 may, for example, be coated using rollers with the fasteners 10 being transported through the rollers and through an oven in string form utilising the end ribbons 32.

Figure 4:
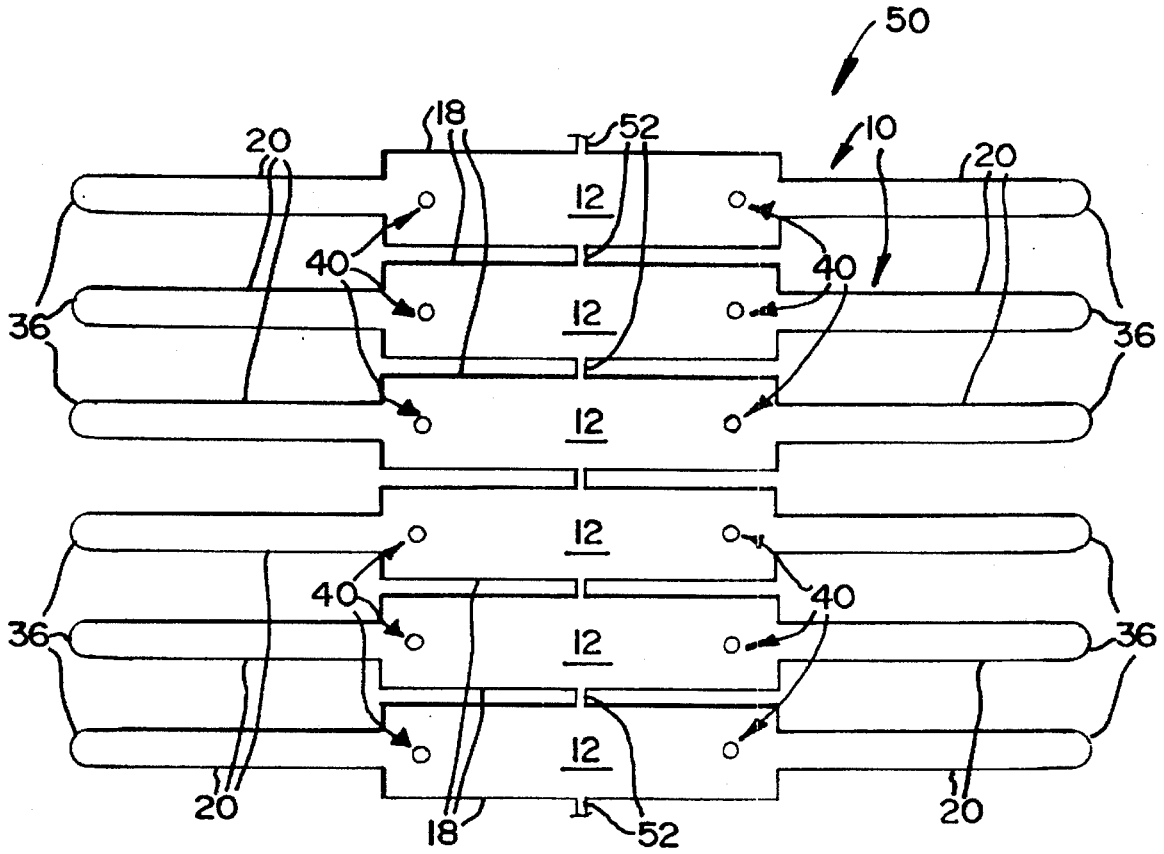
FIG. 4 shows a string of file fasteners in accordance with a second embodiment of the second aspect of the invention.

In FIG. 4, reference numeral 50 generally indicates a string of the file fasteners 10 in accordance with a second embodiment of the second aspect of the invention. With the string 50, the file fasteners 10 are arranged in a side-by-side manner with the body portions 18 of adjacent file fasteners 10 being connected by a frangible bridge 52. The string 50 is manufactured in a similar manner to the string 30.

However, with the string 50, a parting cut between the body portions 18 is not made. Material between the body portions 18 is removed in a similar manner as the removal of material between the prongs 20. Said material between the body portions 18 is removed so that the bridges 52 remain.

It will be appreciated that with the string 50, the ribbons 32 can be dispensed with, thereby obviating the small uncoated tip areas which result when the ribbons 32 are utilised.

I claim:

1. A file fastener, which is of a flat metal strip which comprises an elongate body portion; and a prong extending from each end of the body portion, each prong being narrower than the body portion to define a pair of shoulders at each end of the body portion and with each prong terminating in a tip and having top and bottom surfaces and narrow side surfaces therebetween, the entire top and bottom surfaces and side surfaces and tips of the prongs having a protective coating.

2. The file fastener as claimed in claim 1, in which the body portion is substantially free of protective coating.

3. The file fastener as claimed in claim 1, in which the body portion also has the protective coating.

4. The file fastener as claimed in claim 1, in which the shoulders are substantially square.

5. A metal sheet comprising a plurality of interconnected file fasteners, each file fastener having an elongate body portion and a prong extending from each end of the body portion, each prong being narrower than the body portion to define a pair of shoulders at each end of the body portion, each prong terminating in a tip and having top and bottom surfaces and narrow side surfaces therebetween, the file fasteners being located side-by-side with the body portion of each file fastener being separably connected to the body portions of adjacent file fasteners, the entire top, bottom and side surfaces and the tips of the prongs being coated with a protective coating.

6. The sheet as claimed in claim 5, further comprising a pair of spaced ribbons, the fasteners being arranged between the ribbons, each file fastener being attached to the ribbons by means of a frangible bridge at a tip of each prong.

7. The sheet as claimed in claim 5, in which the body portions of adjacent file fasteners are connected by a frangible bridge.

8. The sheet as claimed in claim 5, in which the body portion of each file fastener is substantially free of protective coating.

9. The string as claimed in claim 5, in which the body portion of each fastener also has a protective coating.

* * * * *